US007472639B2

(12) United States Patent
Park

(10) Patent No.: US 7,472,639 B2
(45) Date of Patent: Jan. 6, 2009

(54) LINEAR COMPRESSOR

(75) Inventor: Jong Rea Park, Seoul (KR)

(73) Assignee: Samsung Gwangju Electronics Co., Ltd. (KR)

( * ) Notice: Subject to any disclaimer, the term of this patent is extended or adjusted under 35 U.S.C. 154(b) by 195 days.

(21) Appl. No.: 11/398,712

(22) Filed: Apr. 6, 2006

(65) Prior Publication Data

US 2006/0245932 A1 Nov. 2, 2006

(30) Foreign Application Priority Data

Apr. 15, 2005 (KR) ..... 10-2005-0031361

(51) Int. Cl.
*F01B 31/12* (2006.01)

(52) U.S. Cl. ..... 92/5 R

(58) Field of Classification Search ..... 91/5 R
See application file for complete search history.

(56) References Cited

U.S. PATENT DOCUMENTS 4,378,726 A * 4/1983 Stoll ..... 92/5 R
6,199,381 B1 * 3/2001 Unger et al. ..... 92/5 R

FOREIGN PATENT DOCUMENTS

| | | |
|---|---|---|
| JP | 01-115719 | 5/1989 |
| JP | 10-278141 | 10/1998 |
| JP | 10-281131 | 10/1998 |
| JP | 11-093846 | 4/1999 |
| JP | 11-294651 | 10/1999 |
| JP | 11-303764 | 11/1999 |
| JP | 2002-505413 | 2/2002 |
| KR | 2001-0003310 | 1/2001 |

* cited by examiner

*Primary Examiner*—F. Daniel Lopez
(74) *Attorney, Agent, or Firm*—Blank Rome LLP

(57) ABSTRACT

A compressor includes a sensor configured to detect a position of a piston; a sensor core configured to reciprocate within the sensor and with the piston; and a core supporting member configured to support the sensor core. The core supporting member is injection molded into the core supporting member, and the sensor core is insert molded into the core supporting member.

9 Claims, 4 Drawing Sheets

LINEAR COMPRESSOR

CROSS-REFERENCE TO RELATED APPLICATION

This application claims the benefit of priority under 35 U.S.C. § 119 to Korean Patent Application No. 2005-31361, filed Apr. 15, 2005, the entire contents are of which are incorporated herein by reference.

BACKGROUND OF THE INVENTION

1. Field of the Invention

The present invention relates to a linear compressor, and more particularly, to a linear compressor capable of detecting a position of a piston.

2. Description of the Related Art

Generally, a linear compressor compresses refrigerant in a cooling apparatus such as a refrigerator, an air conditioner, or the like. The linear compressor works by moving a piston forward and backward.

However, in the conventional linear compressor, the sensor core is tightly inserted into and is fixed to the core supporting member by caulking. When the core supporting member is curved, it is difficult to fix the sensor core at a desired position. As a result, the position of the piston cannot be precisely detected.

SUMMARY OF THE INVENTION

The present invention has been made in view of the above-mentioned problems, and an aspect of the invention is to provide a linear compressor in which a core supporting member for supporting a sensor core is prevented from deforming, the sensor core may be positioned at a precise position, and the position of the piston may be more precisely detected.

To this end, a first non-limiting aspect of the present invention provides a compressor, which includes: a sensor configured to detect a position of a piston; a sensor core configured to reciprocate within the sensor and with the piston; and a core supporting member, configured to support the sensor core, wherein the core supporting member is injection molded, and wherein the sensor core is insert molded into the core supporting member.

Yet another non-limiting aspect of the present invention provides a compressor, which includes: a piston configured to reciprocate; a sensor having a detection hole for detecting a position of the piston; a sensor core configured to reciprocate with the piston within the detection hole; and a core supporting member, including a reinforcing member and configured to support the sensor core, wherein the core supporting member is injection molded, and wherein the sensor core and the reinforcing member are insert molded into the core supporting member during the injection molding of the core supporting member.

The present invention further provides a compressor, which includes: a cylinder block; a compression chamber positioned at the cylinder block; a piston configured to reciprocate in the compression chamber; at least one sensor configured to detect a position of the piston; at least one sensor core configured to reciprocate with the at least one sensor and the piston; and at least one core supporting member injection molded and configured to support the at least one sensor core, wherein the at least one sensor core is integrally formed with the at least one core supporting member.

Additional aspects and/or advantages of the invention will be set forth in part in the description, which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENTS

Figure 1:
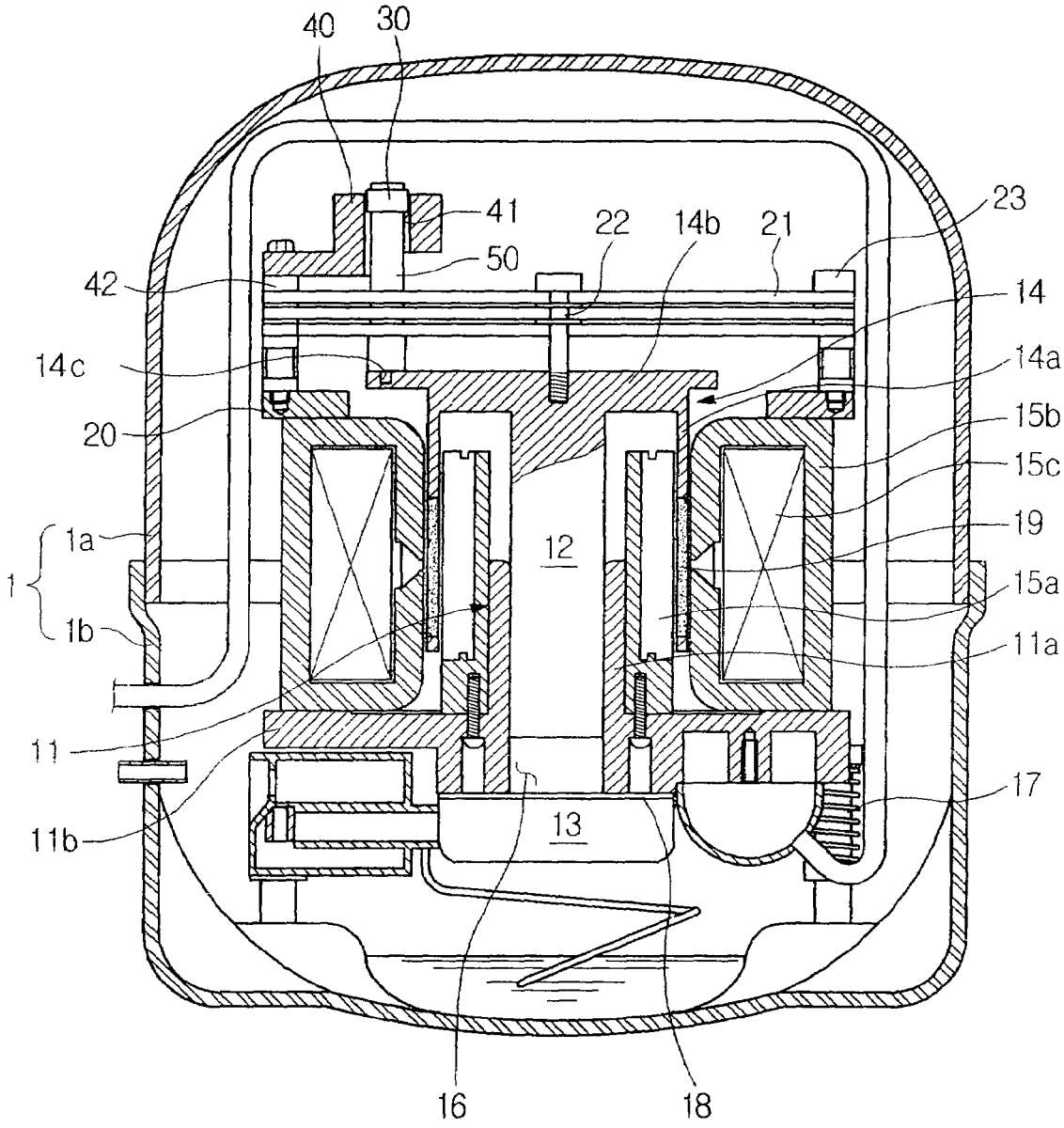
FIG. 1 is a sectional view schematically illustrating a linear compressor according to a non-limiting embodiment of the present invention.

Hereinafter non-limiting embodiments of the present invention will be described in detail with reference to the accompanying drawings, in which like reference numerals represent like elements.

The conventional linear compressor may include a cylinder block in which a compression chamber is formed, as well as a piston that may reciprocate in the compression chamber of the cylinder block. The driving device for reciprocating the piston may include a mover with which a cylindrical magnet surrounding the cylinder block and having an end coupled with the piston is integrally formed, a linear motor including an inner stator and an outer stator respectively fixed to the inside and the outside of the magnet of the mover, and a coil wound in the outer stator.

When electric power is applied to the coil of the outer stator through the above-described configuration, the magnet interacts with the magnetic field generated between the inner stator and the outer stator to reciprocate the mover. Due to the reciprocation of the mover, the piston reciprocates vertically in the compression chamber to compress the refrigerant in the compression chamber.

Moreover, a fixed frame may be installed in the upper side of the outer stator to fix the outer stator. In the upper side of the fixed frame, a multiple fold plate spring may be installed to increase the kinetic energy of the piston using its own elasticity.

In the upper side of the plate spring, a detection device for detecting the reciprocation of the piston may include a sensor core reciprocated with the mover, and a cylindrical sensor having a detection hole for detecting the reciprocation of the sensor core.

The sensor may be fixed to a sensor supporting member in an upward direction. The sensor core installed may be an upper outer side of the rod shaped sensor supporting member such that the sensor core is fixed to the upper side of the mover. The sensor core may be tightly inserted into an upper outer surface of the core supporting member and may be coupled to the core supporting member by caulking. As a result, the sensor core may reciprocate within the detection hole during the reciprocation of the mover.

The detection device may detect the position and an amplitude of the piston by detecting the reciprocation of the sensor core. The detection device may adjust voltage and frequency of electric power applied to the linear compressor so that the conditions for operating the linear compressor are optimized.

In more detail, a linear compressor according to a non-limiting embodiment of the present invention (as shown in FIG. 1) may include a sealed container 1 formed by an upper container 1*a* and a lower container 1*b* coupled with the upper container 1*a* and sealed therebetween.

A compression device may include cylinder block 11, piston 12, and cylinder head 13. A linear motor, which may include a mover 14 and stators 15*a* and 15*b* configured to drive the compression device may be installed in the sealed container 1 with the compression device.

The cylinder block 11 may include a cylinder part 11*a* having a compression chamber 16, as well as a support 11*b* extended from the lower circumference of the cylinder part 11*a* to support the lower side of an outer stator 15*b* (described later). The support 11*b* may be spaced apart from the bottom of the sealed container 1 by a plurality of buffering members 17 for supporting a lower side thereof.

The piston 12 may be installed to reciprocate in the compression chamber 16 of the cylinder block 11. In the lower side of the cylinder block, which may be associated with the compression chamber 16, the cylinder head 13 may be installed such that a suction chamber (not shown) and a discharge chamber (not shown) may be formed therein. Between the cylinder block 11 and the cylinder head 13, a valve plate 18 may be provided such that the suction chamber (not shown) and the discharge chamber (not shown) may alternately communicate with the compression chamber during the reciprocation of the piston 12.

Moreover, the stator of the linear motor may include the cylindrical inner stator 15*a* (which may be fixed to the outer side of the cylinder part 11*a* of the cylinder block) and the cylindrical outer stator 15*b* (which may be fixed to the outer side of the inner stator 15*a* to be spaced apart from the inner stator 15*a*). The outer stator 15*b* may have a coil wound therein.

The mover 14 may include a cylindrical part 14*a* disposed between the inner stator 15*a* and the outer stator 15*b*, as well as a fixing part 14*b* for covering the upper side of the cylindrical part 14 to be connected to the upper side of the piston 12. The cylindrical part 14*a* may be integrally formed with the magnet 19 to interact with the magnetic field generated between the inner stator 15*a* and the outer stator 15*b* when power is applied, such that the mover reciprocates.

The upper side of the outer stator 15*b* may be supported by a frame 20. Frame 20 may be fixed, for example, and/or may be provided separately. In the upper side of the frame 20, an elastic member, such as spring 21 may be installed. The spring 21 may be a multiple fold plate spring and may be used for increasing the kinetic energy of the reciprocating mover 14. Other elastic members may be substituted for the spring. The spring 21 may be installed such that a central part thereof is coupled with the fixing part 14*b* of the mover 14 by a fastener 22 (e.g., a bolt) and the outer end is fixed to a spring supporting member 23 extended from the upper side of the fixed frame 20. For example, the spring supporting member 23 may be extended in an upward direction.

Through this configuration, when alternating current electric power is applied to the coil 15*c* of the outer stator 15*b*, a magnetic field may be generated between the inner stator 15*a* and the outer stator 15*b*. Due to the alternating current, the magnetic field, whose polarities are periodically changed, interacts with the magnet 19 of the mover 14 to reciprocate the mover 14 vertically. By doing so, the piston 12 (which may be integrally formed with the mover 14) may be caused to reciprocate within the compression chamber 16 to compress the refrigerant suctioned into the suction chamber (not shown) and to discharge the compressed refrigerant through the discharge chamber (not shown). The reciprocation of the piston 12 may be further increased by the elastic movement of the plate spring 21.

Meanwhile, the amplitude and the velocity of the piston 12 may be dependent on the voltage and frequency of the alternating current applied to the coil 15*c*. The linear compressor may adjust the voltage and the frequency of the alternating current power applied to the outer stator 15*b* to vary the output property of the linear compressor such that the amount of the discharged refrigerant can be adjusted. The adjustment of voltage and frequency of the input power may be carried out based on a detected position of the piston 12.

To detect the position of the piston 12, a detection device may be provided proximate to the spring 21. The detection device may include a sensor core 30 which may reciprocate with the mover 14, as well as a cylindrical sensor 40 configured to detect the reciprocation of the sensor core 30. The sensor 40 may use a detection hole 41 when detecting the reciprocation. A coil-type displacement detection sensor may be used as the sensor 40.

Thus, during compression of the refrigerant in the compression chamber 16, the sensor core 30 may reciprocate in the detection hole 41 of the sensor 40 at the same amplitude as the reciprocation of the piston 12. At that time, through the change of the magnetic field generated in the sensor 40, the position and the amplitude of the piston 12 can be estimated and detected.

The sensor 40 may be fixed by a sensor supporting member 42 extended to the upper side of the fixed frame 20. The sensor core 30 may have a cylindrical shape and may be positioned at the upper outer side of a rod shaped core supporting member 50 fixed to the upper side of the mover 14 such that the sensor core 30 detects the inside of the detection hole 41 during the reciprocation of the mover 14.

Meanwhile, in the linear compressor according to a non-limiting embodiment of the present invention, the core supporting member 50 may be manufactured by injection molding. The sensor core 30 may be integrally formed with the core supporting member 50 by being insert molded into the core supporting member 50 during the injection molding of the core supporting member 50.

Figure 2:
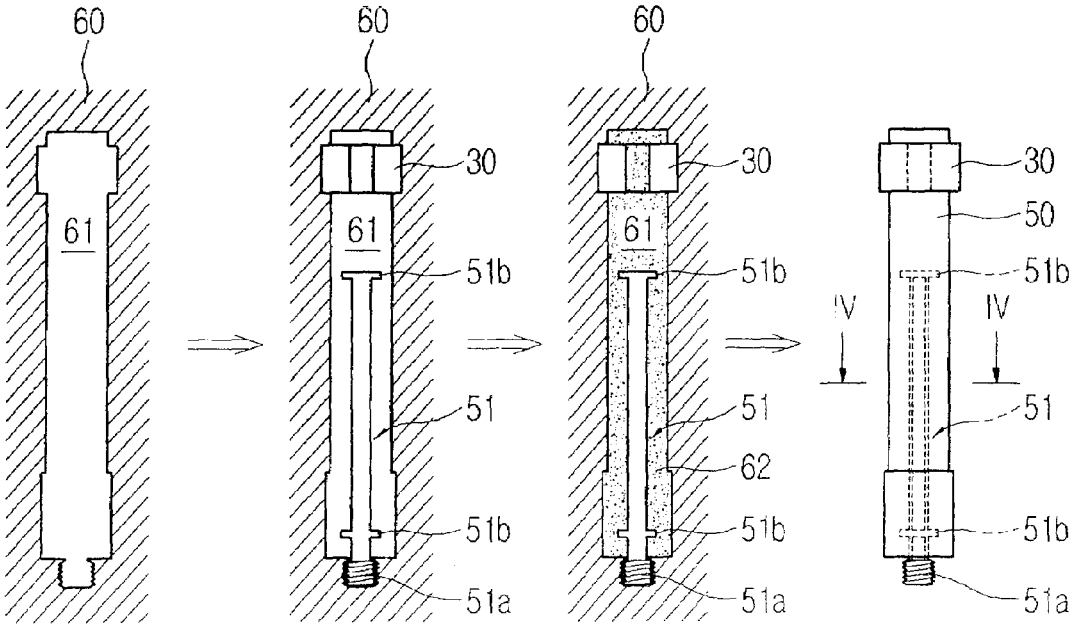
FIG. 2 is a schematic view illustrating a manufacturing process of a core supporting member with which a sensor core is integrally formed according to a non-limiting embodiment of the present invention.

In other words, as shown in FIG. 2, the core supporting member 50 may manufactured such that the sensor core 30 may be fixed in a molding space 61 of a mold 60 corresponding to a shape of the core supporting member 50. The sensor core 30 may be provided in the upper outer side of the core supporting member 50, for example. Molten resin 62 for forming the core supporting member 50 may be poured into the molding space 61 and the sensor core 30 may be secured to the surface of the molten resin 62 when the core supporting member 50 is manufactured. Thus, the sensor core 30 may be integrally formed with the core supporting member 50 without a separate process.

As a result, there is no need to couple the sensor core 30 to the core supporting member 50 by a separate process such as fitting, caulking, or the like, unlike the conventional art. Therefore bending deformation of and damage to the core supporting member 30 caused by coupling the sensor core 30 can be prevented.

Moreover, if the sensor core 30 is insert molded into the core supporting member 50 during injection molding of the core supporting member 50, the sensor core 30 may be more effectively positioned at the upper outer side of the core supporting member 50, as compared to the conventional art in which the sensor core 30 is tightly inserted into the core supporting member 50. The position where the sensor core 30 may be fixed in the forming space 61 prior to injection of the molten resin 62, and can be precisely maintained even when the injection of the molten resin is completed.

The outer diameters of the portions of the core supporting member 50 above and below where the upper side and the lower side of the sensor core 30 are positioned may be slightly larger than the inner diameter of the sensor core 30. Therefore, the sensor core 30 does not become separated from the core supporting member 50 even when a fitting force between the inner diameter of the sensor core 30 and the outer diameter of the portion of the core supporting member 50 is slightly weak.

Moreover, the core supporting member 50 may include reinforcing member 51 for reinforcing the rigidity of the core supporting member 50 inserted into the core supporting member 50 in the longitudinal direction. The reinforcing member 51 may be insert molded into the core supporting member 50. For example, it may be insert molded together with the sensor core 30 during the injection molding of the core supporting member 50. Thus, the core supporting member 50 may be injection molded and may have a strong rigidity due to the reinforcing member 51. The reinforcing member 51 may be integrally formed with the core supporting member 50 without a separate coupling process.

Additionally, in the lower side of the reinforcing member 51, a coupling part 51*a* may be formed to extend outward from the lower side of the core supporting member 50 (opposite to the sensor core 30) and may be coupled with the fixing part 14*b* of the mover 14. The coupling part 51*a* may have male threads formed in the outer circumference thereof such that the coupling part 51*a* may be fastened into a fixing hole 14*c* provided in a side of the fixing part 14*b* of the mover 14 and formed with female threads. By doing so, when the injection molded core supporting member 50 is fastened with the metal mover 14, the core supporting member 50 having relatively weak rigidity may be prevented from wearing.

To prevent the reinforcing member 51 from releasing from the core supporting member 50 or from rotating within the core supporting member 50 even when the fitting force of the reinforcing member 51 is slightly weakened, extension parts 51*b* may be extended from the sides of the reinforcing member 51 inserted into the core supporting member 50 in the direction perpendicular to the longitudinal direction of the reinforcing member 50. The reinforcing member 51 may have a polygonal cross-section when taken along the direction perpendicular to the longitudinal direction.

Since the fitting force between the reinforcing member 51 and the core supporting member 50 may slightly weaken when the molten resin 62 is excessively shrunk after drying, the reinforcing member 51 may be released from the core supporting member 50 or may rotate within the core supporting member 50 while coupling the coupling part 51*a* with the fixing hole 14*c* of the mover 14. To prevent this, extension parts 51*b* may be formed in the sides of the reinforcing member 50. Reinforcing member 50 may have a polygonal cross-section so that extension parts 51*b* may be locked by the core supporting member 50. Consequently, it is possible to prevent the reinforcing member 50 from separating from the core supporting member 50 even when the core supporting member 50 is loosely fitted to the outside of the reinforcing member 51. As a result, rotation of the reinforcing member 50 is effectively restricted due to the cross-section of the reinforcing member 50.

Figure 3:
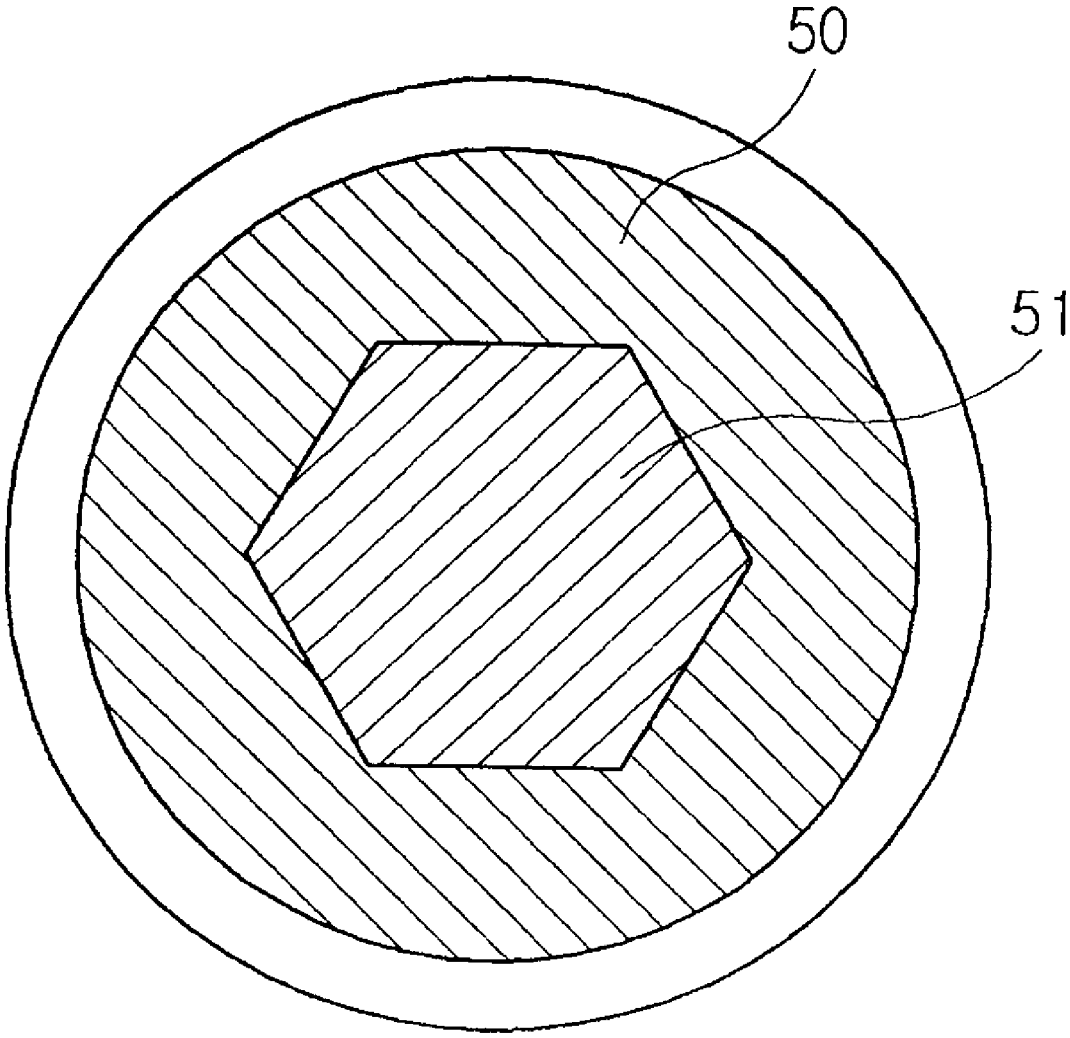
FIG. 3 is a sectional view of the core supporting member of FIG. 2, taken along the line VI-VI and seen from arrows in the drawing.

For reference, in this non-limiting embodiment, a pair of the extension parts 51*b* may be formed in the upper and lower sides of the reinforcing member 51. In more detail, extension parts 51*b* may be formed in ring-shapes, such that the reinforcing member 51 is more effectively prevented from separating from the core supporting member 50. Moreover, the cross-section of the reinforcing member 51 may have a hexagonal shape as shown in FIG. 3, as well as other various polygonal shapes.

Figure 4:
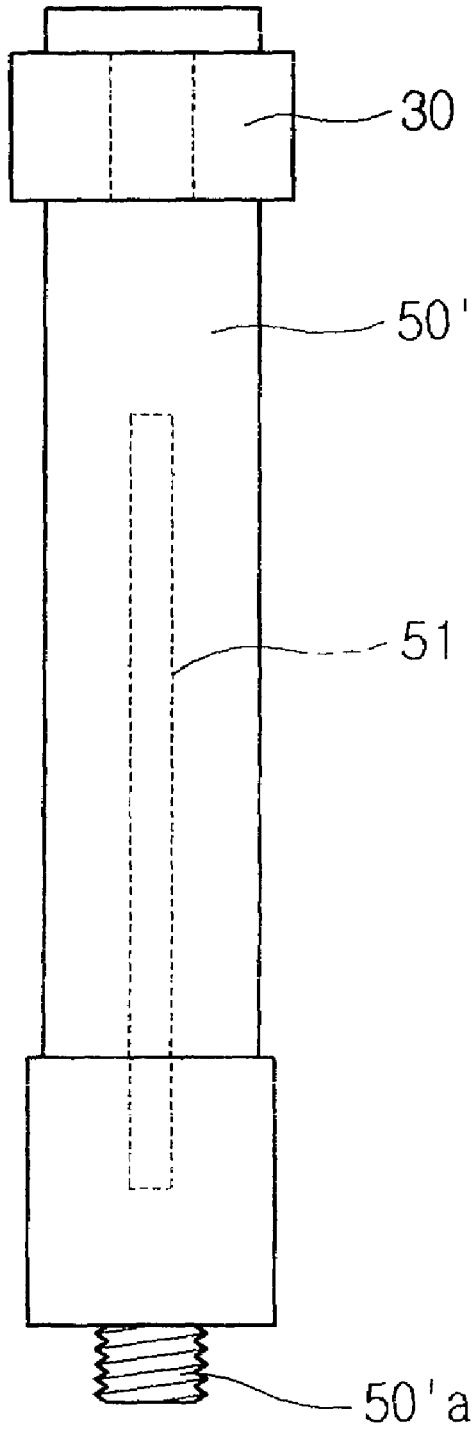
FIG. 4 is a view illustrating a core supporting member with which a sensor core is integrally formed according to another non-limiting embodiment of the present invention.

Molten resin 62, which may be used during the injection molding of the core supporting member 50, may be manufactured by mixing several resins including an engineered plastic having excellent wear resistance such as, by way of non-limiting example, polybutylene terephthalate (PBT). When the content of the PBT is increased (which may increase wear resistance), the core supporting member 50' does not wear when the coupling part 50'*a* is fastened in the fixing hole 14*c*. This is true even when the core supporting member is adapted such that a reinforcing member 51' is completely inserted into the core supporting member 50' and a coupling part 50'*a* is formed with male threads to fasten the lower end of the core supporting member 50' to the fixing hole 14*c* of the mover 14, (as illustrated, for example, in FIG. 4).

However, since the reinforcing member 51' is completely inserted into the core supporting member 50', there may be no extension part 51*b* formed in the reinforcing member 51'. The reinforcing member 51' may have a circular cross-section, in which case there is no fear of the reinforcing member 51' being separated from the core supporting member 50' or rotating within the core supporting member 50' during the coupling of the coupling part 50'*a* with the fixing hole 14*c* of the mover 14.

As described above, according to the linear compressor of non-limiting embodiments the present invention, the sensor core for detecting the position of the piston in association with the sensor may be integrally formed with the core supporting member by insert-molding during injection molding of the core supporting member so that there is no need to couple the sensor core to the core supporting member by a separate process, such as fitting or caulking. Thus, bending deformation and damage of the core supporting member caused by coupling the sensor core can be prevented.

When the sensor core may be insert molded into the core supporting member during the injection molding of the core supporting member, the position where the sensor core is fixed can be precisely maintained even when molten resin is completely injected. As a result, the sensor core may be more effectively positioned in the core supporting member.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A compressor, comprising:

a cylinder block in which a compression chamber is formed;

at least one stator provided at the cylinder block and configured to generate a magnetic field;

a mover coupled to a piston and configured to reciprocate the piston in the compression chamber based on an interaction with the magnetic field;

a sensor configured to detect a position of the piston;

a sensor core configured to reciprocate within the sensor and with the piston; and a core supporting member coupled to the mover at a first end and configured to support the sensor core at a second end, wherein the core supporting member is injection molded, and wherein the sensor core is insert molded into the core supporting member.

2. The compressor according to claim 1, wherein:

the core supporting member includes a reinforcing member adapted to be inserted into the core supporting member to couple the core supporting member to the mover, and the reinforcing member is insert molded into the core supporting member with the sensor core.

3. The compressor according to claim 2, wherein the reinforcing member includes a polygonal cross-section in a longitudinal direction thereof.

4. The compressor according to claim 2, wherein the reinforcing member includes at least one extension part extended from a side of the reinforcing member perpendicular to the reinforcing member.

5. The compressor according to claim 4, wherein the at least one extension part has a ring shape.

6. The compressor according to claim 5, wherein the at least one extension part is formed in at least one of an upper portion and a lower portion of the reinforcing member.

7. A compressor, comprising:

a cylinder block in which a compression chamber is formed;

at least one stator provided at the cylinder block and configured to generate a magnetic field;

a mover coupled to the piston and configured to reciprocate the piston in the compression chamber based on an interaction with the magnetic field;

a sensor having a detection hole for detecting a position of the piston;

a sensor core configured to reciprocate with the piston within the detection hole; and a core supporting member including a reinforcing member and configured to be coupled to the mover at a first end and to support the sensor core at a second end, wherein the core supporting member is injection molded, and wherein the sensor core and the reinforcing member are insert molded into the core supporting member during the injection molding of the core supporting member.

8. The linear compressor according claim 7, wherein the core supporting member is injection molded using a molten resin.

9. The compressor according to claim 7, wherein the reinforcing member is adapted to be inserted into the core supporting member to couple the core supporting member to the mover.

* * * * *